United States Patent [19]

Woodward

[11] Patent Number: 5,012,394

[45] Date of Patent: Apr. 30, 1991

[54] HAND PORTABLE LIGHT WITH EXTENDABLE LAMP HOUSING

[76] Inventor: John G. Woodward, 5736 Cobb Creek Rd., Rochester, Mich. 48064

[21] Appl. No.: 271,429

[22] Filed: Nov. 15, 1988

[51] Int. Cl.[5] ..... F21L 7/00; F21S 1/12

[52] U.S. Cl. ..... 362/198; 362/413; 362/419

[58] Field of Search ..... 362/190, 198, 199, 427, 362/191, 269, 270, 287, 371, 260, 413, 419, 431

[56] References Cited

U.S. PATENT DOCUMENTS

| | | | |
|---|---|---|---|
| 1,338,222 | 4/1920 | Hazelett | 362/199 X |
| 1,743,535 | 1/1930 | Edmondson | 362/419 X |
| 2,885,539 | 5/1959 | McDermott | 362/198 X |
| 3,519,812 | 7/1970 | Brindley et al. . | |
| 3,784,206 | 1/1974 | Sluss | 362/199 X |
| 3,851,166 | 11/1974 | Kohler | 362/198 |
| 3,944,806 | 3/1976 | Jones et al. | 362/191 |
| 3,961,175 | 6/1976 | Otagoshi | 362/199 |
| 4,181,929 | 1/1980 | Barber et al. | 362/413 X |
| 4,309,745 | 1/1982 | Zelina, Jr. | 362/260 |
| 4,772,993 | 9/1988 | Engel | 362/419 |
| 4,802,074 | 1/1989 | Puschkarski | 362/419 X |
| 4,803,606 | 2/1989 | Rotter | 362/419 X |

FOREIGN PATENT DOCUMENTS

| | | |
|---|---|---|
| 726518 | 5/1932 | France . |
| 151 | 3/1907 | United Kingdom . |

*Primary Examiner*—Stephen F. Husar
*Assistant Examiner*—Peggy Neils
*Attorney, Agent, or Firm*—Harness, Dickey & Pierce

[57] ABSTRACT

A hand portable light with extendable lamp housing which can be used as a hand-held device or can be used as a freestanding device when placed on a generally horizontal surface. The lamp housing is mounted to the base of the portable light by two telescoping collapsible support arms. The telescoping arms allow the lamp housing to be elevated above the base housing so that the light emitted from the lamp housing may be broadcast in the surrounding area. The lamp housing is mounted to the telescoping support arms with pivots which allow the lamp housing to be pivoted with respect to the collapsible support arms. This pivoting motion allows the extendable lamp housing to be rotated so that its emitted light may be positioned in a direction that can best accommodate the user's needs. Three battery powered embodiments of the hand portable light are disclosed, including one utilizing a fluorescent lamp.

20 Claims, 4 Drawing Sheets

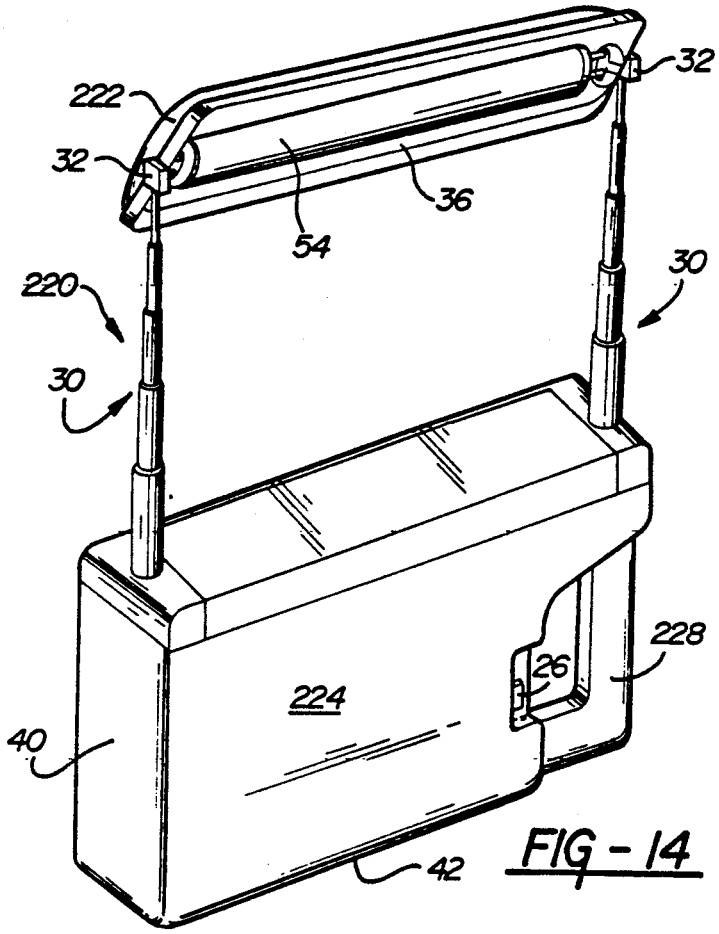
FIG - 14
FIG - 15
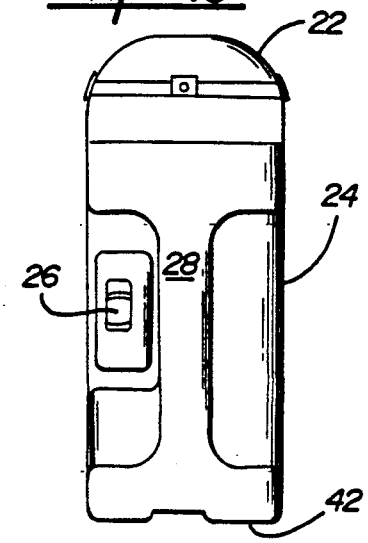
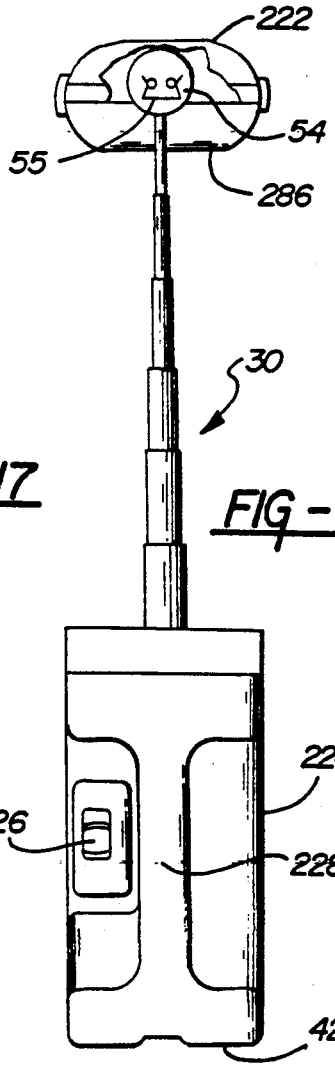
FIG - 16
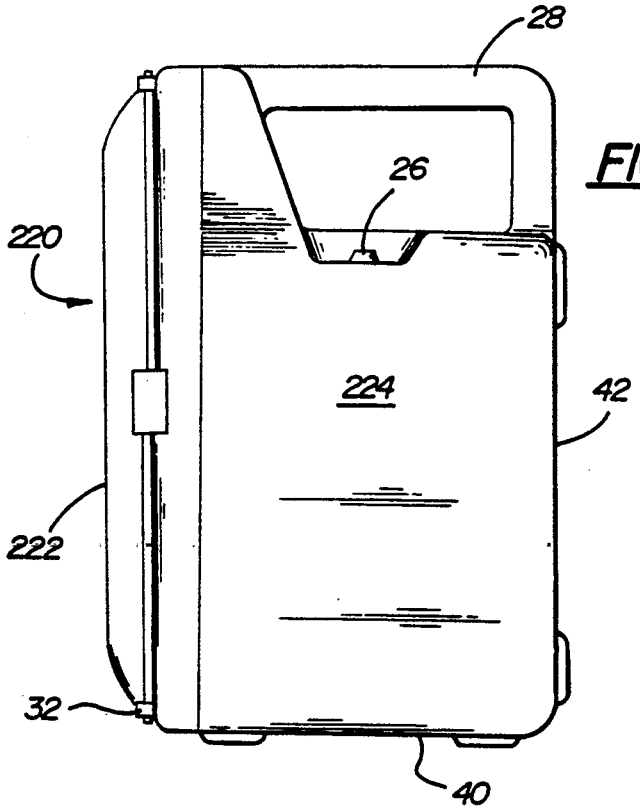
FIG - 17

HAND PORTABLE LIGHT WITH EXTENDABLE LAMP HOUSING

TECHNICAL FIELD

The present invention generally relates to hand portable electric lanterns and deals more specifically with hand portable battery operated lamp devices which have a pivoting extendable lamp housing which allows for positioning the lamp's light in the most desirable direction.

BACKGROUND OF THE INVENTION

Various battery operated hand portable lamps have been developed which provide a source of light where conventional electric power is not available or practical. Such devices are commonly known as flashlights, electric lanterns, or portable utility lights. In addition to requiring lighting in remote places it is also often desirable to be able to place the light source on a flat surface and direct the light beam to most effectively serve the user. Such applications include playing board games at night while camping or working on one's automobile.

Numerous hand portable lamp devices are presently being marketed including many types of flashlights using one or more size A, size C or size D batteries. Some hand portable lamps use one or more 6 volt dry cells. One such device is the EVERREADY TM, Model No. 5209 electric lantern known as the "Indoor-/Outdoor Commander" and available from Union Carbide Corp. of Danbury, Conn. This device uses two 6 volt dry cell batteries and a tubular fluorescent lamp. This lantern, like most flashlights, is essentially comprised of a single body portion and does not allow for independent movement between the lantern body and its lamp. Consequently, if no convenient surface is available to place the lantern on, the user must hold it in order to maximize the lighting in a desired area. The Ray-o-Vac Company markets a portable lantern similar to the EVEREADY Commander in that they both house the illuminescent member and the batteries within a common housing. This type of arrangement, while satisfactory in applications where light positioning is not critical, suffers from the same drawbacks as the EVEREADY Commander and consequently provides undesirable results when the light must be critically positioned.

One lantern device which does allow for the positioning of the illuminescent member independent from the lantern's base is shown in U.S. Pat. No. 3,519,812, issued to Brindley and entitled "Portable Electric Lantern with Swivel Type Lamp Assembly." The Brindley patent discloses a lantern case and a swivel type lamp assembly adapted to be elevated above the case for illuminating the surface on which the lantern is placed. Although the Brindley patent does disclose a portable lantern with a swivel lamp, it is not designed to be used in applications where the light emitted from the lantern must be directed to areas other than the surface on which the lantern is placed. The Brindley lantern uses one lamp post to support the overhead lamp assembly. In order to adequately support the assembly, this single post must be quite wide. Thus, another drawback of the Brindley device is the undesirable shadow that is cast on account of its wide lamp post.

Accordingly, it is a primary object of the present invention to provide a hand portable light with a base housing and extendable lamp housing such that the light emitted from the lamp housing is capable of being positioned in a multiplicity of directions without moving the base housing.

A further object of this invention is to provide a hand portable light as described above wherein the shadows cast from the extensions which support the lamp housing are minimized, so as to facilitate night-time activities requiring fairly uniform lighting from a portable battery-powered light source.

Still another object of the invention is to provide a hand portable light having telescoping rod antennas which can support or hold a lamp housing at anyone of a variety of attitudes, as desired by the user.

SUMMARY OF THE INVENTION

In light of the foregoing objects, there is provided according to one aspect of the present invention a hand portable light with extendable lamp housing comprising a base housing and a lamp housing. Extending between the base housing and lamp housing are two collapsible arms. The arms are rigidly attached to the base housing and they are pivotally attached to the lamp housing. The lamp housing includes a conventional or suitable lamp socket to receive an electrically powered illuminating device such as an incandescent lamp or fluorescent lamp. In the preferred embodiments the base housing is adapted to receive the batteries for the portable flashlight. The collapsible arms allow the base housing to remain in a stationary position while the lamp housing it pulled away from the base housing. The pivoting connection between the collapsible arms and the lamp housing allows the lamp housing to be swiveled or rotated with respect to the collapsible arms. In one embodiment, the two collapsible arms are each comprised of at least a first tube and a second tube, with each tube having an elongated outer body surface and an insertion hole defined by an inner tube wall which is generally parallel to the elongated outerbody surface. The first tube's insertion hole is dimensioned such that the second tube is telescopically received within the insertion hole of the first tube. Several techniques are disclosed for providing electrical connections between the base housing and lamp housing, including two where the metal portions of the telescoping arms are used as the electrical conductors.

BRIEF DESCRIPTION OF THE DRAWINGS

In the accompanying drawings where the like numerals refer to similar components in the various embodiments and Figures:

FIG. 14 is an isometric drawing of a third embodiment of the hand portable light of the present invention which has an extendable lamp housing, shown in an extended usable position, and designed for use with a straight fluorescent lamp;

FIG. 15 is a side orthographic view of the hand portable light of FIG. 14 with its extendable lamp housing in the collapsed storage position;

FIG. 16 is a side orthographic view of the hand portable light shown in FIG. 14 with a cut-away section of the extendable lamp housing showing a portion of the fluorescent tube detail; and FIG. 17 is a front orthographic view of the hand portable light as shown in FIG. 14 with the extendable lamp housing in a retracted storage position.

DETAILED DESCRIPTION OF THE PREFERRED EMBODIMENTS

Figure 1:
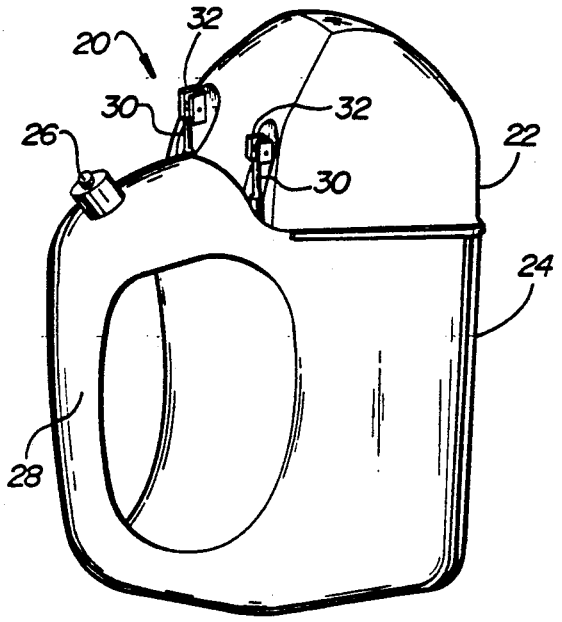
FIG. 1 is an isometric drawing of a first embodiment of the hand portable light of the present invention with its extendable lamp housing shown in the storage position.

In accordance with the present invention, FIG. 1 shows a first embodiment of a hand portable light having an extendable lamp housing. Flashlight 20 shown in FIG. 1 comprises a lamp housing 22, a base housing 24, and two collapsible support arms 30, which are preferably made of chromed steel or tin, but can be made of any suitable strong material. The collapsible arms 30 are rigidly fixed to the base housing 24 and fixed to the lamp housing by way of pivots 32 which may be of any suitable design such as a hinge mechanism. The pivots 32 allow the lamp housing 22 to be rotated or swiveled with respect to the collapsible support arms 30. Attached to the light 20 is a carrying handle 28 which has an on-off switch 26 for turning the hand portable light on and off located thereon as shown.

Figure 2:
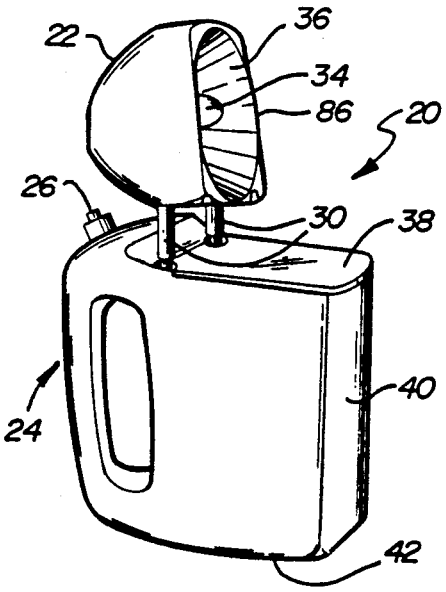
FIG. 2 is an isometric drawing of the portable light of FIG. 1 with its extendable lamp housing shown pivoted up into a usable position.

Reference is now made to FIG. 2 which shows the hand portable light 20 of FIG. 1 with its extendable lamp housing 22 in one of the many usable positions it can assume. Mounted within the extendable lamp housing 22 is an incandescent lamp 34, an incandescent lamp socket 35 (not shown), a lamp reflector 36, and a clear protective cover 86. The lamp reflector 36 acts in conventional manner to concentrate the light emitted from incandescent lamp 34, while clear protective cover 86 acts in conventional manner to protect the lamp 34 from breakage while in use and also protects lamp reflector 36 from undesired contact with abrasive materials which would scratch it and thereby reduce its optical reflective properties. Access cover 38 provides a means of accessing the components mounted within the base housing 24. The physical construction of the base housing 24 and the lamp housing 22 can be of injection-molded plastic, stamped metal or of any combination of conventional or suitable preferably lightweight materials used in conventional flashlights and electric lanterns. The unit can also be made waterproof by sealing the openings around the on-off switch 26, access cover 38, collapsible support arms 30 and any other openings.

Figure 3:
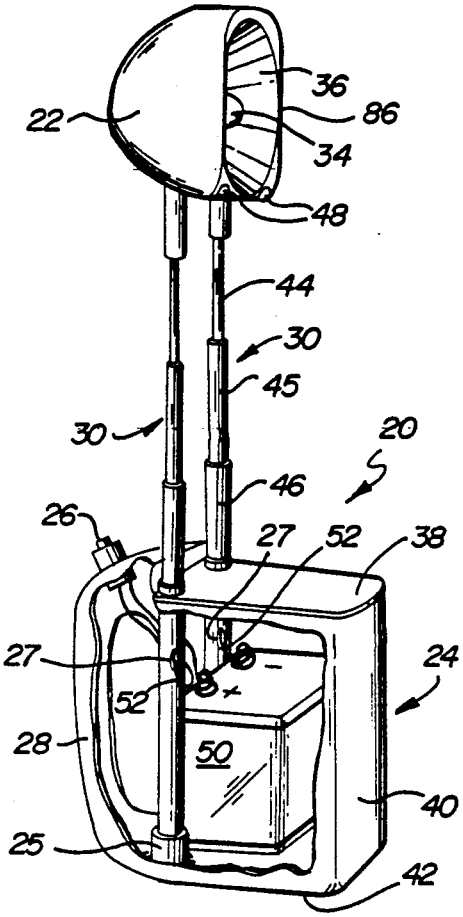
FIG. 3 is an isometric drawing of the portable light of FIG. 1 showing a cut-away section of the base housing and also showing the lamp housing in an extended usable position.

Referring now to FIG. 3, the base housing 24 is shown with a portion thereof cut away, exposing the most pertinent aspects of its internal construction. The battery 50 is shown as a conventional six-volt dry cell such as an Eveready Super Heavy-Duty Model 1209 six-volt lantern battery. The battery 50 is connected in series with on-off switch 26 and also in series with incandescent lamp 34. Conductors 52 travel from the base housing 24 to the lamp housing 22 by route of the collapsible support arms 30. The conductors 52 are in intimate electrical contact with the collapsible support arms 30 on account of being soldered or otherwise suitably fastened at locations 27. In this particular embodiment, the electric current travels through the collapsible metal support arms 30 and is conducted by conventional electric wires (not shown) inside the lamp housing 22 to the incandescent lamp 34. Within the base housing 24 adjacent to the battery pack 50 is shown anchoring mount 25. This anchoring mount 25 acts to rigidly support and retain its respective collapsible support arm 30. The collapsible support arms 30 shown in FIG. 3 are each comprised of three support arm tubes 44, 45, and 46. The largest support arm tube 46 is firmly received into the base housing 24 and retained by the anchoring mount 25. The end of the largest support arm tube 46 projects from the base housing 24 and is dimensioned so that it frictionally receives the intermediate support arm tube 45. The intermediate support arm tube 45 in turn frictionally receives the smallest support arm tube 44 within its center opening. When the lamp housing 22 is pulled away from the base housing 24, the three support arm tubes 44, 45, 46 of each collapsible support arm 30 move in a telescoping fashion to allow the lamp housing 22 to be elevated above the base housing 24. This telescoping action of the collapsible support arms 30 allows the user of the hand portable light 20 to position and direct the light from lamp 34 to best suit the user's needs. Since each of the metal tubes 44, 45 and 46 remain in intimate electrical contact with adjacent tubes, the electric circuit between the battery 50, and the lamp 34 is still intact and allows the lamp 34 to light. Support arm channels 48 in the lamp housing 22 receive the collapsible support arms 30 when the lamp housing 22 is in a storage position. This allows the clear protective cover 86 to lie flat against the access cover 38, thereby minimizing any chance of breaking the clear protective cover 86 or scratching it while it is not in use. The hand portable light is shown in FIG. 3 as it would be used when placed on a flat surface, such as a table or a workbench.

Figure 4:
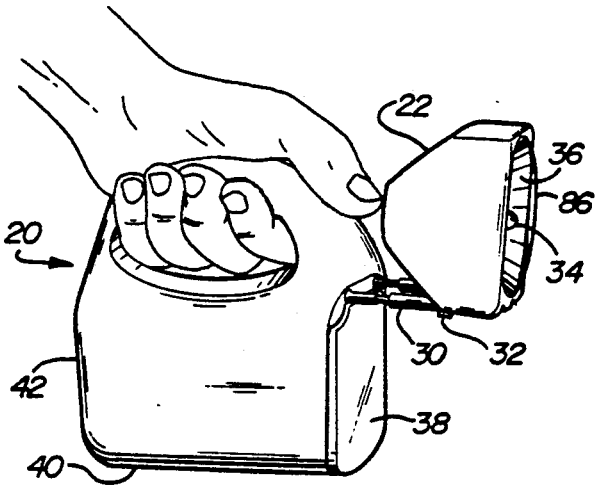
FIG. 4 is an isometric drawing showing the portable light of FIG. 1 with its lamp housing pivoted about 180 degrees from its FIG. 1 position and having its handle grasped by the hand of a user.

FIG. 4 shows the hand portable light with extendable lamp 20 as it would be used as a conventional hand-held flashlight. When used in this manner, the collapsible support arms 30 remain in a collapsed position, but the extendable lamp housing 22 is pivoted about the pivots 32 so that lamp 34 assumes a position 180 degrees from its normal storage position. This permits the light emanating from lamp 34 to be directed in front of the user.

Figure 5:
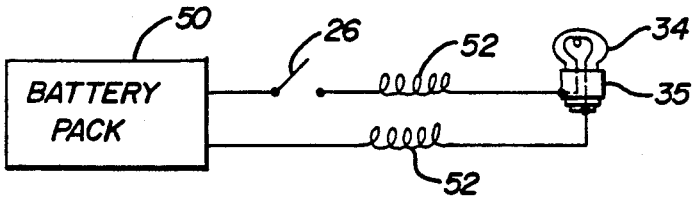
FIG. 5 is an electrical schematic diagram representing a typical circuit used in the hand portable light of FIGS. 1 through 4 and 10 through 13 which is designed to operate an incandescent light bulb.

Referring now to FIG. 5, the schematic diagram shows one preferred circuit which may be used to provide power to the incandescent lamp 34 in conventional socket 35 in the embodiments shown in FIGS. 1 through 4 and FIGS. 10 through 13. The circuit is simply a battery pack 50 which could consist of only one battery or may consist of several batteries. Battery pack 50 is connected in series to an on-off switch 26 which permits the user to selectively turn the incandescent lamp 34 on or off. In series with the switch 26 is incandescent lamp 34 which provides the illumination of the flashlight. Coiled conductors 52 represent the extendable and collapsible tubes 44, 45 and 46 of the two arms 30. Alternatively, they may be said to represent conventional multi-filament copper wire coiled in helical loops, which provides a separate path for electric current while allowing for the extension of the collapsible support arms while still maintaining electrical continuity between the incandescent lamp 34, the battery pack 50 and the on-off switch 26. Two alternative embodiments using such coiled conductors 52 are illustrated in FIGS. 7 and 8 and will be discussed in greater detail below.

Figure 6:
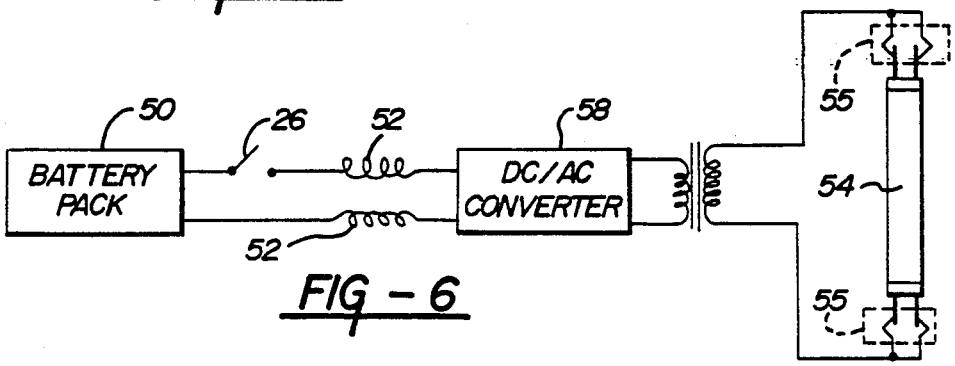
FIG. 6 is an electrical block diagram of a circuit which may be used in the hand portable light of FIGS. 14 through 17 which is designed to operate a fluorescent lamp.

FIG. 6 shows a block diagram of the electrical circuit which may be used in the hand portable light of the present invention shown in FIGS. 14 through 17. The battery pack 50 is used to supply the electrical current for the operation of the portable light, and an on-off switch 26 allows the user of the portable light to turn the unit on or off. The power from the battery pack is converted from a direct current ("DC") to an alternating current ("AC") by way of a conventional DC-to-AC converter 58. This conversion is necessary in order to allow the step-up transformer 56 to boost or step up the voltage output by the battery pack 50 before it is provided to the fluorescent lamp 54 held in conventional fluorescent lamp sockets 55. The step-up transformer is connected to the output of the DC-to-AC converter 58 and produces at its output an amplified voltage sufficient in magnitude to ionize the gas contained within fluorescent lamp 54. Any suitable DC-to-AC converter and step-up transformer may be used such as those found in the Eveready or Ray-O-Vac lanterns discussed above. The transformer 56 and the converter 58 are preferably located within the lamp housing, as in the Eveready lantern. Coiled conductors 52 carry the current between the switch 26 and battery pack 50 and the DC-to-AC converter 58.

Figure 7:
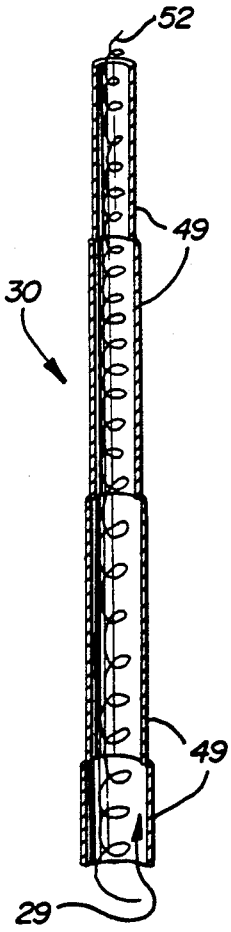
FIG. 7 is a front orthographic section view of a collapsible support arm having an electric wire running through its center.
Figure 8:
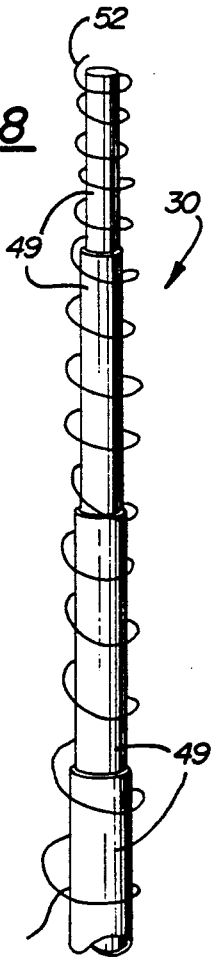
FIG. 8 is a front orthographic view of a collapsible support arm showing an electric wire encircling the collapsible arm from its base to its top.
Figure 9:
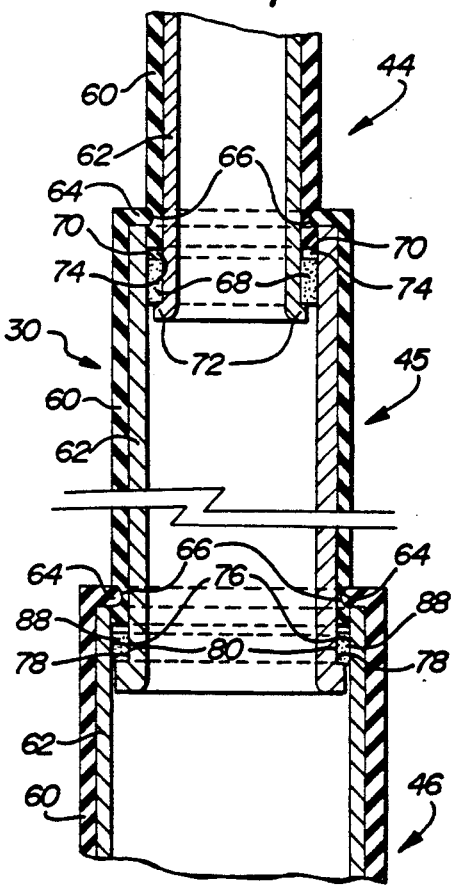
FIG. 9 is an enlarged fragmentary sectional view of one embodiment of a collapsible arm which uses the electrically conductive characteristics of the arm to conduct current between the base housing and the lamp housing.

FIGS. 7 through 9 show three alternative methods of or arrangements for carrying the current between the battery pack 50 in base housing 24 and the lamp in the housing 22. These arrangements are more expensive than the arrangement disclosed in FIG. 3, but provide a lower resistance electrical path for the electric current, which could be beneficial. A first preferred alternative arrangement is depicted in FIG. 7 which shows a sectional view of a collapsible support arm 30 which is comprised of a plurality of support arm tubes 49. Conventional or standard telescoping rod antennas of the type used in portable radios may be used in this and other embodiments for the support arms 30, since such rod antennas are commercially available from several different sources in a wide variety of sizes and lengths. Depending upon the particular embodiment and relative size of such embodiment, such rod antenna support arms may range in extended length from about 250 mm to about 2000 mm or more, with about 400 mm to about 1000 mm in extended length being preferred. By "extended length" is meant the length from the very bottom of the rod antenna to the top of the rod antenna (where the pivot or hinge is located) when the rod antenna is fully extended. The largest diameter of the rod antenna is preferably not more than 15 mm in diameter and is preferably in the range of 5 to 10 mm in diameter. The two rod antenna support arms are preferably spaced apart by at least 30 mm center-to-center spacing. The plurality of support arm tubes 49 are telescopically received within each other so as to permit the extending and collapsing of the collapsible support arm 30. Within the hollow channel 29 which travels through the center of the collapsible support arm 30 is disposed a tightly coiled conductor 52. Placement of the coiled conductors 52 within the hollow channels 29 of the collapsible support arms 30 are not only convenient places to run the coiled conductors 52, but the arms 30 also act as protective conduits for the coiled conductors 52 which may help minimize any damage to the conductors 52 that may be caused by inadvertent bumping or other adverse treatment.

FIG. 8 shows a second embodiment of a collapsible support arm 30 comprised of a plurality of support arm tubes 49. The collapsible support arm 30 does not act as a conduit for coil conductor 52 as it did in FIG. 7, but rather is used as a center post around which the coiled conductor 52 is wound. While this design is not as secure from accidental bumping as is the design in shown in FIG. 7, should be somewhat less expensive than and is potentially easier to repair than the design shown in FIG. 7. Also, a suitably electrically-insulated rugged, multi-stranded wire may be used in the FIGS. 7 and 8 constructions to minimize the possibility of damage to the conductors 52 and electrical shock hazard.

FIG. 9 is a front orthogonal, sectional view of a third embodiment of a collapsible arm. Like the collapsible support arms 30 as shown in FIGS. 7 and 8, the collapsible support arm 30 shown in FIG. 9 serves to support the weight of the overhead lamp housing, like the first embodiment in FIG. 3, it additionally functions as an electrical conductor by conducting current from the battery pack 50 in the base housing 24 to the lamp 34 in the lamp housing 22. The design shown in FIG. 9 provides an electrically insulated collapsible support arm 30 that eliminates any need for insulated coiled conductors 52 to provide for protection against electrical shock because the conductive support arm tubes 44, 45, and 46 which provide a current-conducting path for the power to be supplied to the lamp 34, have an electrically insulating covering as will be further explained. One arm 30 is used to provide current from the battery pack 50 to the lamp 34, and the other arm 30 is used as a return path for the current coming from lamp 34 and returning to battery pack 50. Conventional telescoping rod antennas may be modified as discussed below to form these support arms 30. The modifications relate principally to providing an insulative covering and electrically conductive brushes as will now be described.

In the most preferred arrangement, each collapsible support arm 30 is comprised of a small support arm tube 44, an intermediate support arm tube 45, and a large support arm tube 46. The small support arm tube 44 is telescopically received within the intermediate support arm tube 45; likewise, the intermediate support arm tube 45 is telescopically received within the large support arm tube 46. An annular recess 66 formed around the outside of small support arm tube 44 receives locking ridge 64 formed at the top of intermediate support arm tube 45 to prevent the tubes 44, 45 from being overextended. The annular recess 66 catches the locking ridge when the small support arm tube 44 is extended to its fullest position and will not permit the smallest support arm tube 44 to be extended any further. A similar arrangement of annular recess 66 and locking ridge 64 is found between intermediate support arm tube 45 and large support arm 46 respectively. To provide an extremely low resistance area of contact between adjacent tubes 44, 45 and 45, 46, a conducting brush 68 is disposed between the two adjacent tubes. The conducting brush 68 is frictionally disposed between the conductive inner tube contact surface 80 and the adjacent conductive outer tube contact surface 88. In the most preferred embodiment, the conducting brush 68 is ring shaped and completely surrounds the conductive inner tube contact surface 80 of each tube 44, 45 and 46. This ring design acts to minimize the electrical resistance by maximizing surface area of contact between any two adjacent tubes. The brush 68 may be made from any suitable brush material such as a carbon composite material conventionally used in hand-held electric tools having electric motors. The conducting brush 68 is loosely retained between the insulated outer skin shoulder 70 and the conductive inner tube flange 72. The boundary defined by the insulated outer skin shoulder 70 and the conductive inner tube flange 72 is made large enough so that a conducting brush gap 74 is maintained. This conducting brush gap 74 allows for a slight wiping movement between conducting brush 68 and conductive inner tube contact surface 80 every time the support arm tubes 44, 45 or 45, 46 move relative to each other. This slight wiping movement of the conducting brush 68 with respect to the conductive inner tube contact surface 80 helps ensure that the ohmic contact made therebetween will remain low in value.

As shown in FIG. 9, the conductive inner tube 62 is shown having an insulative outer skin 60. This insulative outer skin 60 ensures that the collapsible support arms 30 will not present a shock hazard to the user and also effectively eliminates the possibility of short-circuiting the battery current in the event that a current path is inadvertently created between the two collapsible support arms 30. The conductive inner tube 62 should be made from a material having low ohmic characteristics such as copper, brass, steel or the like. The insulative outer skin 60 may be made from rubber, plastic, epoxy resin or any other suitable material having high electrical insulation characteristics which can be glued or otherwise bonded to the conductive inner tubes.

Figure 10:
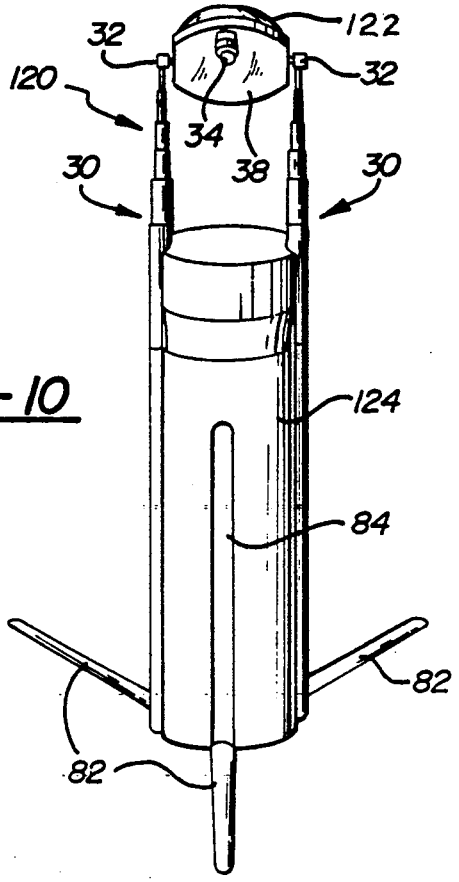
FIG. 10 is an isometric drawing of a second embodiment of a flashlight of the present invention showing its extendable lamp housing in one of its many usable extended positions and supported by three support legs in which each are pivotable between an extended position, as shown, as a retracted position.

Referring now to FIG. 10, a second embodiment of the present invention, namely a portable flashlight 120 with extendable lamp housing 122 is shown having two collapsible support arms 30, and a base housing 124 which is sized to easily fit within the user's grasp. The portable flashlight 120 can be used as a hand-held unit or can be placed on a horizontal surface wherein retractable support legs 82 are pivoted from support leg recesses 84 and placed in an extended position. The retractable support legs 82 act as a support base for the flashlight 120 and allow it to be used as a freestanding unit. Collapsible support arms 30 can be extended to any desired height within their range, and pivots 32 allow the extendable lamp housing to be rotatably positioned so that the light emitted from lamp 34 is directed to the most advantageous position for the user.

Figure 11:
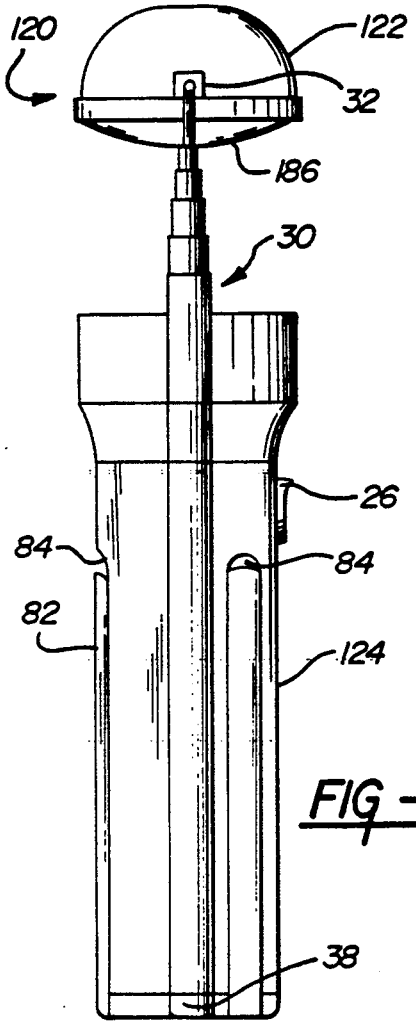
FIG. 11 is a front orthographic view of the FIG. 10 flashlight shown with its lamp housing and support legs in their retracted storage positions.
Figure 13:
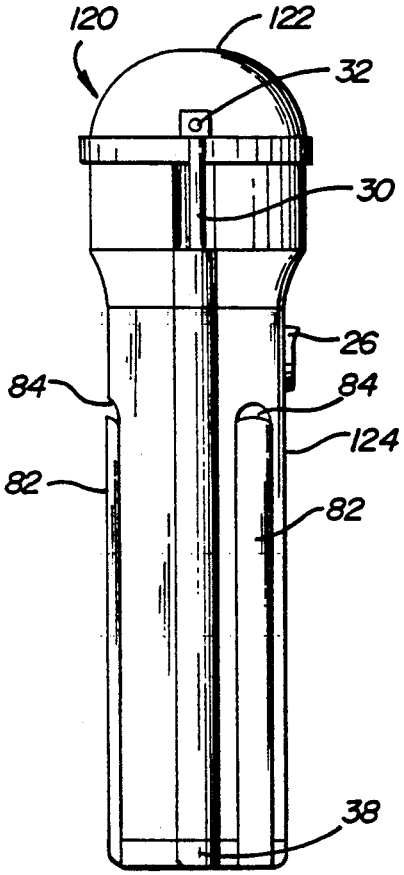
FIG. 13 is a front orthographic view of the flashlight shown in FIG. 11 with its lamp housing in an extended usable position.
Figure 12:
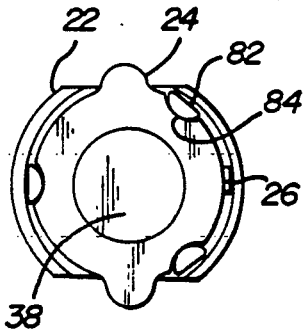
FIG. 12 is a bottom orthographic view of the flashlight shown in FIG. 11.

FIGS. 11, 12 and 13 are orthogonal projections of the flashlight 120 shown in FIG. 10. FIG. 11 shows the positioning of the lamp housing 122 prior to placing it in its storage position. The lamp housing 122 must be rotated about the pivots 32 until its clear protective cover 86 directly faces the top of the base housing 24. The lamp housing 122 is then depressed, which collapses the support arms 30 until its clear protective cover 86 is completely received within the recess provided for it in the top of the base housing 24. This recess acts to protect the clear protective cover 86 while the unit is in storage. The retractable support legs 82 are rotated from their sprawled position, as shown in FIG. 10, and rotated into their respective support leg recesses 84 when the unit is to be used as a hand-held flashlight or when the unit is in storage.

FIG. 13 depicts how the flashlight 120 shown in FIG. 11 appears once the lamp housing 122 has been completely received by the recess on the top of the base housing 124. FIG. 12 shows a bottom view of the flashlight 120 specifically depicting the access cover 38 whereby the batteries used therein are removed from and placed into the base housing 124. FIG. 12 also shows the position of the retractable support legs 82 when they are received by the support leg recesses 84.

Now referring to FIG. 14, this embodiment of the hand portable light with extendable lamp housing is designed in a similar manner to the previously discussed units with the exception that it employs a fluorescent lamp 54 instead of the conventional incandescent lamp 34. The portable light 220 is shown having an extendable lamp housing 222, a base housing 224, and two collapsible support arms 30 which interconnect the base housing 224 to the extendable lamp housing 222. The lamp housing 222 is pivotably connected at its ends to the collapsible support arms 30. When the extendable lamp housing 222 is swiveled about the pivots 32, the fluorescent lamp 54 swivels with it, and accordingly the light emitted from the fluorescent lamp may be easily pointed in a direction which is most advantageous to the user. Lamp housing 222 is also provided with a lamp reflector 236 which maximizes the light which is emitted from the lamp housing. The base housing 224 is provided with a vertical base surface 40 and a horizontal base surface 42. Either base 40 or 42 can be used when the unit is placed upon a flat surface. Handle 228 is provided on the base housing 24 so that the hand portable light 20 can be used as a hand held unit. On-off switch 26 is also provided for convenient on-off switching of the fluorescent lamp 54.

FIGS. 15 and 16 are side views of the portable light 220 as shown in FIG. 14. FIG. 15 shows the portable light 220 as it is viewed in its storage position. Collapsible support arms 30 are in their retracted position, and the clear protective cover 286 is completely received within the top of the base housing 224. FIG. 16 shows the same side view as that shown in FIG. 15, except that the extendable lamp housing 222 is shown in an extended position. A partial cutaway view of the extendable lamp housing 222 exposes the end of the fluorescent lamp 54 and the fluorescent lamp retaining socket 55.

FIG. 17 shows a front orthogonal view of the portable flashlight 20 as it is viewed when resting on its vertical base 40. The extendable lamp housing 22 is showed in its storage position with the clear protective cover 86 completely retracted within the recess provided for it in the top of the base housing 24.

From the foregoing, it may be appreciated that three embodiments of a novel hand portable light with extendable lamp housing are disclosed herein which not only provide for the accomplishment of the objectives of the invention, but do so in a particularly effective and reliable manner. It is recognized that those skilled in the art may make various modifications or additions to the preferred embodiments chosen to illustrate the invention without departing from the spirit and scope of the present contribution to the art. For example, the number of concentrically arranged tubes which make up each telescoping arm may be varied any where from two or three up to ten or more. Other designs for the base housing and lamp housing may be used. Any one of the four arrangements shown in FIGS. 3 and 7, 8 and 9 for conveying electric current between the battery in the base housing and lamp in the lamp housing may be used with any one of the three preferred embodiments of the hand portable lights of the present invention. Also, power for the lamp in the lights may alternatively be provided from a DC power source such as a cigaret lighter in a car or the battery in a boat. Moreover, in the third embodiment, the DC/AC converter and step-up transformer may be located in the base housing 224 if desired. Also, if additional strength or rigidity is required for the lamp housing in any of the embodiments, three or four spaced-apart telescopic arms, rather than the two shown, may be used. For example, in the third embodiment, a telescoping arm could be located in each of the four corners of lamp housing 222/base housing 224 combination. Accordingly, it is to be understood that the protection sought and to be afforded hereby should be deemed to extend to the subject matter claimed below and all fair equivalents thereof.

I claim:

1. A free-standing hand portable light of the electric flashlight or electric lantern type with an extendable lamp housing comprising:

a free-standing lightweight, portable, readily movable base housing easily lifted by one hand;

a lightweight electrical lamp housing coupled to said base housing and easily movable by hand with respect to said base housing;

first and second telescopically collapsible arms spaced apart from one another, each said arm having a first end and a second end, the first end of each said arm being rigidly attached to said base housing, said telescopically collapsible arms allowing said electrical lamp housing to be telescopically positioned at any one of several user settable distances away from the base housing when said light is in use; and pivot means for permitting said lamp housing to be swiveled with respect to the second ends of said first and second collapsible arms said pivot means allowing said lamp housing to be rotatably positioned at any one of several user-settable positions to direct illumination from said lamp housing in a desired direction.

2. A hand portable light as recited in claim 1 wherein said pivot means includes first and second hinges, said first hinge connecting said second end of said first collapsible arm to said lamp housing and said second hinge connecting said second end of said collapsible arm to said lamp housing.

3. A portable light as recited in claim 1 further comprising:

socket means, located within the lamp housing, for receiving an electrically powered lamp; and means for delivering electrical power from said lamp housing to said illuminating device, and wherein the base housing includes at least one chamber for receiving at least one electrical battery.

4. A hand portable light as recited in claim 3 wherein said socket means for receiving includes an incandescent lamp socket.

5. A hand portable light with extendable lamp housing as recited in claim 3 wherein said means for receiving includes means for holding a fluorescent lamp.

6. A hand portable light as recited in claim 1 wherein each said collapsible arm further comprises a first and second tube, with each said first tube having an elongated outer body surface and a hole defined by an inner tube wall which is generally parallel to said elongated outer body surface, said first tube dimensioned such that said second tube is telescopically received within said hole of said first tube.

7. A hand portable light of the electric flashlight or electric lantern type with extendable lamp housing comprising:

a lightweight, portable base housing easily lifted by one hand;

a lightweight lamp housing coupled to said base housing and easily movable by hand with respect to said base housing;

first and second pivots spaced apart from one another, each said pivot having a first end and a second end, the first end of each said pivot being rigidly attached to said lamp housing; said pivots allowing said lamp housing to be rotatably positioned at any one of several user-settable positions to direct illumination from said lamp housing in a desired direction;

first and second telescoping arms spaced apart from each other, each said arm having a first and a second end, said first end of each said arm being rigidly attached to said base housing, said second end of said first arm being attached to said second end of said first pivot, and said second end of said second arm being attached to said second end of said second pivot, said telescopically collapsible arms allowing said electrical lamp housing to be telescopically positioned at any one of several user settable distances away from the base housing when said light is in use;

means for receiving an electrically powered illuminating device within said lamp housing; and means for delivering electric current to said illuminating device receiving means.

8. A hand portable light as recited in claim 7 wherein each of said first and second telescoping arms further comprises at least:

a small support arm tube; and a large support arm tube;

said support arm tubes each having an elongated outer body surface and a centrally located hole defined by an inner tube wall which is generally parallel to said elongated outer body surface, said hole of said large support arm tube being dimensioned such that said elongated outer body surface of said small support arm tube is received within the hole of said large support arm tube;

said telescoping arms being movable between a collapsed position and at least one extended position, and anchored in said base housing in a manner permitting said telescoping arms to support said lamp housing at a distance above the base housing when said telescoping arms are in an extended position.

9. A hand portable light as recited in claim 8 wherein said means for delivering current includes at least one electric wire extending from said base housing to said lamp housing which passes through the holes of said large and small support arm tubes in at least one of the telescoping arms.

10. A hand portable light as recited in claim 8 wherein said current delivering means for delivering current includes at least one electric wire extending from said base housing to said lamp housing contained outside of said elongated outer body surface of the large and small support arm tubes of at least one of the telescoping arms, said one electric wire being coiled about the large and small support arm tubes of said one telescoping arm.

11. A hand portable light as recited in claim 8 wherein at least one of said telescoping arms has support arm tubes comprised of electrically conductive material, and said means for delivering current uses the support arm tubes of said one telescoping arm as at least part of an electrical conductor within the light that provides electrical power to the means for receiving an electrically powered illuminating device.

12. A hand portable light as recited in claim 11 further comprising an electrically conductive brush means disposed between said elongated outer body surface of said small support arm tube and said inner tube wall of said large support arm tube for conducting current between said small support arm tube and said large support arm tube.

13. A hand portable light as recited in claim 12 wherein said conductive brush includes carbon.

14. A hand portable light as recited in claim 11 wherein said electrically conductive material is covered by a skin of electrically insulative material.

15. A hand portable light of the electric flashlight or electric lantern type with an extendable lamp housing operable via battery power, the light comprising:

a lightweight, portable base housing easily lifted by one hand including at least a first chamber for receiving therein at least one battery and including means for making electrical connection to at least one battery;

a lightweight lamp housing including socket means for receiving a lamp, said lamp housing coupled to said base housing and easily movable by hand with respect to said base housing;

a first and second generally cylindrical telescoping collapsible arms spaced apart from and parallel to one another, said arms having first and second ends, said first ends of said arms rigidly connected to said base housing, said telescopically collapsible arms allowing said electrical lamp housing to be telescopically positioned at any one of several user settable distances away from the base housing when said light is in use;

first and second pivot means for swivelably connecting said lamp housing to said first and second arms, said pivot means being spaced apart from one another and each being connected to the second end of a respective one of said first and second arms, said pivot means allowing said lamp housing to be rotatably positioned at any one of several user-settable positions to direct illumination from said lamp housing in a desired direction; and electrical conductor means for providing plural electrical connections between the means for making electrical connections and the socket means for receiving a lamp, said electrical conductors associated respectively with said first and second telescoping collapsible arms such that said conductors are extendable and collapsible at the same time that said arms are extended or collapsed.

16. A hand portable light as recited in claim 15 wherein each of said cylindrical telescoping arms includes standard telescoping rod antennas and said rod antennas form part of said electrical conductors.

17. A hand portable light as recited in claim 15 wherein said cylindrical telescoping arms are not greater than 15 mm in diameter, and spaced apart by at least 30 mm.

18. A hand portable light as recited in claim 16 wherein said cylindrical telescoping arms are not greater than 500 mm in length when fully extended.

19. A hand portable light as recited in claim 15 further comprising an electrical lamp mounted in said socket means.

20. A hand portable light as recited in claim 19 further comprising at least one battery.

* * * * *